United States Patent [19]

Maeda et al.

[11] Patent Number: 4,916,013

[45] Date of Patent: Apr. 10, 1990

[54] ARTIFICIAL HAIR AND PRODUCTION THEREOF

[75] Inventors: Katsura Maeda; Masao Kawamoto; Sadao Sanada, all of Kurashiki, Japan

[73] Assignee: Kuraray Co., Ltd., Kurashiki, Japan

[21] Appl. No.: 135,079

[22] Filed: Dec. 18, 1987

[51] Int. Cl.[4] ..... D02G 3/00

[52] U.S. Cl. ..... 428/374; 428/372; 428/373; 428/397; 428/400

[58] Field of Search ..... 428/372, 397, 400, 373, 428/374; 264/177.13, 171

[56] References Cited

U.S. PATENT DOCUMENTS

| | | | |
|---|---|---|---|
| 3,790,434 | 2/1974 | Sone et al. | 428/400 |
| 4,032,685 | 6/1977 | Yamada et al. | 428/400 X |
| 4,254,182 | 3/1981 | Yamaguchi et al. | 428/372 |
| 4,311,761 | 1/1982 | Kanbara | 428/397 |
| 4,451,534 | 5/1984 | Akagi et al. | 428/400 X |
| 4,522,873 | 6/1985 | Akagi et al. | 428/400 X |
| 4,764,426 | 8/1988 | Nakamura et al. | 428/400 |

*Primary Examiner*—Lorraine T. Kendell

*Attorney, Agent, or Firm*—Oblon, Spivak, McClelland, Maier & Neustadt

[57] ABSTRACT

Disclosed herein is polyester-based aritifical hair composed of individual filaments having a thickness of 30 to 70 denier, with a deviation of plus and minus 20 denier, and a roughened surface formed such that the average intervals of adjacent pits are 0.1 to 1.5 μm and the density of pits is 5 to 100 pits in a planer distance of 10 μm. The artificial hair looks like natural hair and keeps its hair style and color unchanged when used both indoors and outdoors.

3 Claims, 2 Drawing Sheets

ARTIFICIAL HAIR AND PRODUCTION THEREOF

BACKGROUND OF THE INVENTION

1. Field of the Invention

The present invention relates to artificial hair which looks like natural hair and keeps its shape well, and it also relates to a process for producing the same.

2. Description of the Prior Art

Wearing a wig is a common practice to hide one's bald head or lack of hair. Wigs of natural hair have been predominant presumably because people believe that they look natural. Unfortunately, this belief is groundless. Natural hair growing on one's head is entirely different from that attached to a wig.

Natural hair, like wool, is covered with a flaky substance called cuticle. This makes it difficult to use natural hair for a wig. The flakes of cuticle on live natural hair are regularly arranged in one direction and hence permit smooth combing. Once natural hair is removed from one's head, it becomes randomly arranged and entangled. To eliminate this trouble, natural hair is treated with a chemical for the removal of cuticle before it is used for a wig. The chemical treatment adversely affects the gloss of natural hair. Moreover, natural hair without cuticle loses strength and durability when it undergoes sterilization and decoloring. The absence of cuticle permits natural hair to absorb water, making natural hair to feel sticky and hard to handle. To remedy this shortcoming, the entire surface of natural hair is coated; but coating is not so effective as to eliminate the disadvantage of chemically treated natural hair that lacks stiffness and loses the hairdo pattern soon. Thus a wig of natural hair gets out of shape easily in a rainy day or windy day.

To eliminate the disadvantage of natural hair, modacrylic fiber was investigated as a synthetic fiber to replace natural hair. It is not satisfactory in settability, however. As a synthetic fiber for general use, polyester fiber is best. A disadvantage of polyester fiber is that it strongly reflects light and produces an undesirable glossy appearance. The light reflection results from the high refractive indexes. (About 1.72 in the direction of the fiber axis and about 1.54 in the direction perpendicular to the fiber axis.)

There has been proposed a variety of processes for producing a synthetic fiber for artificial hair having an improved gloss. One of them is disclosed, for example, in Japanese Patent Publication No. 40689/1973. According to this process, the synthetic fiber is incorporated with a polyalkylene ether compound in the production stage. Subsequently, the fiber is treated with a solvent which dissolves the polyalkylene ether compound but does not dissolve the fiber. After the treatment a myriad of microscopic voids are formed in the fiber. They make the synthetic fiber resemble natural hair in luster and hand.

In the case of ordinary 0.5–5 denier fiber for clothing, voids in fibers make the dyed fiber look whitish. However, this does not apply to thick fiber (30 to 70 denier) having microscopic voids, 1 to 0.5 μm in diameter, in which case the dyed fiber does not look whitish but retains a bright color. Unfortunately, it is difficult to form microscopic voids in fibers in an accurately controlled manner, and the polyalkylene ether compound causes the dyed fiber to discolor on account of its extremely poor light resistance.

On the other hand, EP137925A discloses a process for treating polyester monofilaments with an alkaline solution, thereby roughening the surface of the monofilaments through leaching and etching. The roughened surface produces the effect of scattering and refracting light. This process, however, is not satisfactory to impart a natural luster to the monofilaments because the mere alkali treatment produces an excessively rough surface.

It is an object of the present invention to provide polyester-based artificial hair resembling natural hair in luster and hand and superior in color fastness to light.

SUMMARY OF THE INVENTION

According to the present invention, there is provided polyester-based artificial hair composed of individual fibers having a thickness defined by the formula (I) below and a roughened surface having specific dimensions defined below.

$$D = X \pm \alpha \qquad \text{(I)}$$

where

D is the thickness of fiber (denier).

X is the average denier, which is 30 to 70 denier.

$\alpha$ is smaller than 20 denier.

The fiber surface is roughened such that the average intervals of adjacent pits are 0.1 to 1.5 μm and there are 5 to 100 pits in a planer distance of 10 μm.

DETAILED DESCRIPTION OF THE INVENTION

Figure 1A:
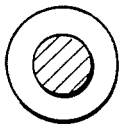
FIG. 1 is a sectional view showing a composite multiple-layer filaments.

The artificial hair of the present invention is composed of thick filaments with a roughened surface whose fineness varies in the range of ±20 denier (preferably ±5 to ±15 denier). Such thick filaments provide luster and hand quite resembling those of natural hair when they are dyed in black or brown. If the deviation ($\alpha$) of the fineness is greater than ±20 denier, the filaments are dissimilar in luster and hand from natural hair. The filaments specified in this invention look like natural hair when finished with hair-oil or the like which are commonly used for natural hair.

The filaments for the artificial hair of the present invention are required to have the specific fineness as mentioned above. With uniform fineness, they are not suitable for a wig which looks like natural hair. The fineness with a certain range of deviation provides the filaments with desirable luster and hand. The deviation of the fineness can be produced in any stage of (1) spinning, (2) drawing, (3) collecting, (4) alkali etching, (5) dyeing, and (6) mixing for color matching. The process in the individual stages is explained in the following.

(1) It is most reasonable to produce filaments having varied diameters by changing the sectional area of the spinneret holes or by changing the throughput from hole to hole in the spinning stage. One disadvantage of this process is that some filaments form loops if spinning tension is inadequate. This disadvantage, however, is easily overcome by performing cooling and take-up under proper conditions. This process is most productive.

(2) Filaments having varied diameters can be produced when raw filaments of varied diameters are drawn at the same draw ratio and the resulting drawn filaments are mixed. This process is most suitable for mass production although it needs a skill to perform drawing at an adequate draw ratio for individual filaments of different size.

(3) In the stage of collecting, it is easy to combine tows of different fineness to produce filaments having varied diameters. This process, therefore, is industrially convenient and suitable for mass production.

(4) It is possible to produce filaments having varied diameters from drawn filaments of uniform diameter when the amount of weight reduction by alkali etching is changed stepwise at proper intervals, say, 5%, 10%, 20%, 30%, and so on, and the thus treated filaments are collected.

(5) To produce filaments having varied diameters in the dyeing stage requires several kinds of filaments which vary in diameter; but it is practical to meet the requirements for various applications.

(6) To produce filaments having varied diameters in the dyeing stage requires several kinds of filaments which vary in diameter; but it has an advantage that it is easy to impart desired hand to the filaments according to individual applications.

Whichever process is employed, it is important that the artificial hair for a wig should vary in thickness; otherwise, the wig lacks the natural luster and appearance. According to the present invention, the diameter should be 30 to 70 denier with a deviation ($\alpha$) of $\pm 20$ denier. Only when this requirement is met, the artificial hair is satisfactory in appearance and hand. In the case of short, thick artificial hair, the deviation ($\alpha$) may be 3 to 5. In the case of long, thin artificial hair for an elegant hair style, the deviation ($\alpha$) may be 7 to 15. The average denier of the artificial hair varies according to the hair length and wig form required.

The average denier should be varied according to the cross section of the individual filaments. In the case of filaments with a flat cross section, the average denier should be on the large side. In the case of filaments with a less flat cross section, the average denier should be on the small side. Such filaments impart a good hand. In any way, the artificial hair having an average thickness lower than 30 denier is excessively soft; and the one having an average thickness higher than 70 denier is excessively hard.

According to the present invention, the filaments constituting the artificial hair are provided with microscopic irregularities on the surface. The irregularities are formed by a myriad of pits which are elongated in the lengthwise direction of the filaments. The pits help the incident light to enter the fiber and reduce the reflection of the incident light at the surface of the fiber, thereby imparting a mild luster to the filaments.

The surface irregularities, which can be observed under a scanning electron microscope, should be formed such that their average intervals are 0.1 to 1.5 $\mu$m. With average intervals smaller than 0.1 $\mu$m, the artificial hair is undesirably glossy; and irregularities formed at average intervals greater than 1.5 $\mu$m make the artificial hair look dull. The number of the surface irregularities should be 5 to 100 in a planar distance of 10 $\mu$m. If it is less than 5, the irregularities do not make any effect, and if it is greater than 100, the irregularities make the artificial hair excessively glossy.

Polyester fibers for clothing assumes a deepened color when they are given minute surface irregularities in the order of light wavelength. However, this is not true of thick fibers having varied diameter used for artificial hair. In the latter case, much larger irregularities impart polyester fibers a mild luster resembling that of natural hair.

So far, no elaborate study has been made on the white delustering agent to be added to artificial hair. It has been selected indiscriminately from titanium oxide, kaolin, talc, calcium carbonate, silica, zinc sulfide, and zinc white in the form of fine particles. Attention was paid only to the amount of addition. However, the present inventors' study showed that some of the above-mentioned fine particles are not satisfactory with regard to luster and texture if they have a refractive index higher than 1.8. This disadvantage is not eliminated even though the filament surface is roughened by chemical treatment. It was found, therefore, that the fine particles to impart a desirable luster and texture to the surface-roughened (alkali-etched), dyed filaments should have a refractive index smaller than 1.8 and an average particle diameter smaller than 1 $\mu$m. The small particle diameter is also important for the prevention of filter clogging.

Preferred examples of the inorganic fine particles which meet the above-mentioned requirements include silicon oxide, metal silicates, calcium phosphate, magnesium phosphate, manganese phosphate, aluminum oxide, barium sulfate, calcium carbonate, and tin oxide. In this invention, it is possible to use fine particles containing more than 80% of the above-mentioned fine particles alone or in combination with one another.

Figure 1B:
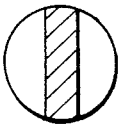
Figure 1C:
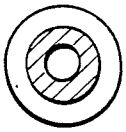
Figure 1D:
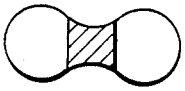
Figure 1E:
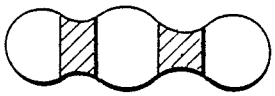
Figure 1F:
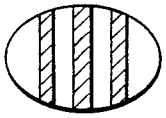
Figure 1G:
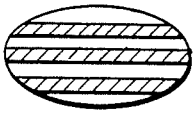
Figure 1H:
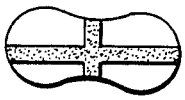
Figure 1I:
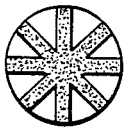

The artificial hair of the present invention may be formed from filaments having a composite multiple-layered structure and modified cross section. This structure may be produced by arranging two or more components, each having a different refractive index, coaxially or side by side. The filaments of composite structure produce a quiet luster even under the sunlight. The cross section of the composite multiple-layer filaments is schematically illustrated in FIG. 1.

A wig made form conventional synthetic filaments has a disadvantage that it needs frequent combing because of the tendency of synthetic filaments to curling after wearing over a long period. The present inventors' study showed that this disadvantage can be eliminated if the filaments have a flat cross section rather than a round cross section. A desired result is obtained when the flatness expressed by a/b is 1.3 to 6.0, where a is the major axis and b is the minor axis. With a flatness a/b smaller than 1.3, the filaments are liable to curling. With a flatness a/b greater than 6.0, the filaments are liable to splitting in the spinning and drawing steps. The flat cross section may be elliptic, cocoon-shaped, rectangular, dumbbell-shaped, three-node-shaped, or dish-shaped. They are not limitative; but any cross section is acceptable so long as the above-mentioned requirement for flatness is met.

Although thick filaments usually tend to become glossy when they have a flat cross section, this is not true of the filaments having the surface roughened with irregularities of specific size and intervals as mentioned above. Therefore, the artificial hair of the present invention resembles natural hair.

Figure 2A:
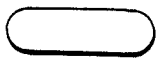
FIG. 2 is a schematic representation of a cross section of the filaments used in the present invention.
Figure 2B:
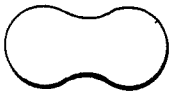
Figure 2C:
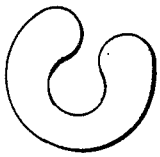
Figure 2D:
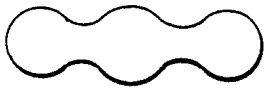
Figure 2E:
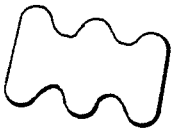
Figure 2F:
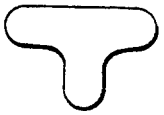
Figure 2G:
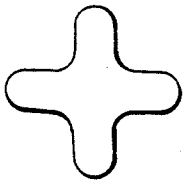
Figure 2H:
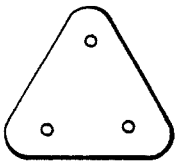
Figure 2I:
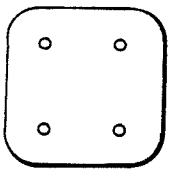

There are instances where it is desirable to produce the artificial hair of the invention from filaments having a modified cross section. An example of such cross section is schematically shown in FIG. 2.

The filaments used for the artificial hair of the present invention can be produced by the ordinary spinning process. However, a special care should be exercised for the cooling of emergent filaments and the post-treatment of solidified filaments, so that the thick filaments do not curl after dyeing. To this end, the cooling air, spinning rate, throughput, and cooling environment should be properly controlled for uniform orientation. In addition, heat setting after drawing is also a means to prevent curling. For uniform orientation and cooling, liquid cooling is preferable to air cooling which is in general use. Liquid cooling is also effective to prevent thick emergent filaments from sticking to one another.

After spinning and cooling, the filaments undergo drawing in the usual way. Hot drawing, especially drawing in hot water, is preferable because of its ability to make the filaments more uniform. The drawing should be followed by heat setting for the prevention of curling resulting from uneven orientation.

The filaments which have undergone drawing and heat setting are collected to form a filament bundle whose total fineness is greater than $10^4$ denier. The filament bundle is treated with a hot alkaline aqueous solution for surface etching until the weight decreases by 6 to 30%. With a total fineness smaller than $10^4$ denier, the filament bundle does not show signs of curling even though it has a potential of curling. In such a case, it is impossible to predict curling which would occur after it has been dyed or made into a wig. A filament bundle having a total fineness of $10^4$ denier permits one to predict how the filament bundle as a whole would behave. Therefore, the total fineness specified above is an important requirement. The filament bundle may be in the form of skein, muff, or soft cheese.

After surface etching with an alkaline solution, the filaments are dyed. The dye bath may be incorporated with an ultraviolet light absorber.

The artificial hair produced as mentioned above should be straight, and they are properly curled and set after they have been made into a wig.

The term polyester as used in the present invention denotes a polyester composed of ethylene glycol or 1,4-butanediol as the major glycol component and terephthalic acid or an ester thereof as the major dicarboxylic acid component.

The dicarboxylic acid component may be partly replaced by monoalkali metal 5-sulfoisophthalate; dicarboxylic acids such as isophthalic acid, diphenyldicarboxylic acid, naphthalene dicarboxylic acid, adipic acid, sebacic acid, and dodecane dicarboxylic acid, and esters thereof; and hydroxycarboxylic acids such as p-hydroxybenzoic acid, p-$\beta$-hydroxyethoxybenzoic acid, and esters thereof. The ethylene glycol or 1,4-butanediol may be partly replaced by other glycols such as alkylene glycol having 2 to 10 carbon atoms, 1,4-cyclohexanedimethanol, 1,4-bis($\beta$-hydroxyethoxy)benzene, and bisglycol ether of bisphenol-A.

The reactants may be incorporated with a chain branching agent such as pentaerythritol, trimethylpropane, trimellitic acid, trimesic acid, and a polymerization stopper such as monohydric polyalkylene oxide and phenyl acetic acid in a small amount.

The above-mentioned raw materials can be made into a polyester by performing the ester interchange of dimethyl terephthalate with ethylene glycol or 1,4-butanediol or by performing the direct esterification of terephthalic acid with a glycol. An alternative process comprises the steps of adding ethylene oxide to terephthalic acid, thereby forming a glycol ester of terephthalic acid and/or an oligomer thereof, and subsequently polymerizing the reaction product.

In the synthesis of the polyester used in the invention, it is possible to employ any known catalyst, color protection agent, delustering agent, agent to prevent the formation of ether linkages, antioxidants, and flame retardants.

The invention will be described in more detail with reference to the following examples.

EXAMPLE 1

(1) Polymer A was prepared as follows: Into 4.84 kg of ethylene glycol was dispersed 1.2 kg of barium sulfate/water paste using a ball mill over a period of 24 hours. (The barium sulfate has a refractive index of 1.5 to 1.6 and an average particle diameter of 0.8 $\mu$m; and the paste contains 33% of water.) To the resulting paste was added 8.65 kg of terephthalic acid to give a slurry.

The slurry was fed to an esterification vessel over 2 hours. The esterification was carried out at 240° C. with continuous removal of water by distillation. The reaction was completed by keeping the vessel at 260° C. for 1 hour. After incorporation with $Sb_2O_3$ (5 g), the resulting ester was transferred to the polymerization vessel, in which polymerization reaction was carried out for 3 hours by raising the temperature to 290° C. and, at the same time, slowly evacuating the vessel to 1 mmHg or below. Thus there was obtained a polymer having an intrinsic viscosity [$\eta$] of 0.72. The polymer was forced into water under nitrogen pressure and cut into chips.

(2) Polymer B having an intrinsic viscosity [$\eta$] of 0.68 was prepared in the same manner as in (1), except that 4.84 kg of ethylene glycol was mixed with 1.5 kg of 20% colloidal silica (having a refrective index of 1.5 and an average particle diameter of 0.045 $\mu$m) and the resulting paste was mixed with 8.65 kg of terephthalic acid and 5 g of $Sb_2O_3$ to give a slurry.

(3) Polymer C was prepared as follows: Into a reaction vessel were charged 10 kg of dimethyl terephthalate, 7 kg of ethylene glycol, and 3.5 g of zinc acetate. The ester interchange reaction was carried out at 200° C. for 4 hours. To the reaction system were added 1.2 g of phosphoric acid and 4 g of $Sb_2O_3$ and, 5 minutes later, 0.26 kg of manganese acetate tetrahydrate, and 5 minutes later, additional 70 g of phosphoric acid, followed by thorough stirring. The polymerization reaction was carried out for 3 hours by raising the temperature to 280° C. and, at the same time, slowly evacuating the vessel to 1 mmHg. Thus there was obtained a polymer having an intrinsic viscosity [$\eta$] of 0.65. The polymer contains a myriad of fine particles of manganese phosphate having a particle diameter smaller than 0.01 $\mu$m and a refractive index of 1.5 to 1.7.

(4) Polymer D was prepared as follows: Into a reaction vessel were charged 10 kg of dimethyl terephthalate, 7 kg of ethylene glycol, 3.5 g of zinc acetate, and 0.3 kg of calcium carbonate having an average particle diameter of 0.5 $\mu$m and a refractive index of 1.67. The ester interchange reaction was carried out at 200° C. for 4 hours. To the reaction system were added 1.2 g of phosphoric acid and 4 g of $Sb_2O_3$. The ester interchange reaction was completed by raising the temperature to 240° C. The polymerization reaction was carried out for 3 hours by raising the temperature to 280° C. and, at the same time, slowly evacuating the vessel to 1 mmHg.

Thus there was obtained a polymer having an intrinsic viscosity [η] of 0.68.

(5) Polymer E having an intrinsic viscosity [η] of 0.78 was prepared in the same manner as in (1), except that 4.84 kg of ethylene glycol was mixed with 1.5 kg of 20% colloidal silica (having a refrective index of 1.5 and an average particle diameter of 0.080 μm) and the resulting paste was mixed with 7.96 kg of terephthalic acid, 0.69 kg of isophthalic acid (8 mol % in total acid components), and 5 g of $Sb_2O_3$ to give a slurry.

(6) For the purpose of comparison, polymer F having an intrinsic viscosity [η] of 0.69 was prepared in the same manner as in (4), except that calcium carbonate was not added. This polymer is so-called super-bright polymer.

(7) For the purpose of comparison, polymer G having an intrinsic viscosity [η] of 0.69 was prepared in the same manner as in (6), except that calcium carbonate was replaced by 5 g of titanium oxide (having an average particle diameter of 0.2 μm and a refractive index of 2.5 to 2.6). This polymer is so-called semi-dull polymer.

(8) For the purpose of comparison, polymer H was prepared as follows: Into 4.84 kg of ethylene glycol was dispersed 8.65 kg of terephthalic acid and 5 g of $Sb_2O_3$ to give a slurry. The slurry was fed to an esterification vessel over 2 hours. The esterification was carried out at 240° C. with continuous removal of water by distillation. Thus there was obtained a reaction product having a degree of esterification of 80%. It was incorporated with 0.5 kg of zinc white (having an average particle diameter of 0.2 μm and a refractive index of 2.0) which had previously been dispersed in 1 kg of ethylene glycol using a ball mill. The reaction was completed by keeping the vessel at 260° C. for 1 hour. The resulting ester was transferred to the polymerization vessel, in which polymerization reaction was carried out for 3 hours by raising the temperature to 290° C. and, at the same time, slowly evacuating the vessel to 1 mmHg. Thus there was obtained a polymer having an intrinsic viscosity [η] of 0.70. The polymer was cut into chips.

Each the above-mentioned eight kinds of polymers was made into filaments by melt spinning through round nozzles using an extruder-type melt spinning machine. The emergent filaments were cooled by warm water at 60° C. at the position 20 cm under the spinneret, and the filaments were further cooled by cold water at 20° C. and finally wound up. The filaments were subsequently drawn in two stages at 75° C. and 98° C. Three kinds of filaments each having a fineness of about 30 denier, 40 denier, and 50 denier were mixed in equal amounts to give a filament bundle having a fineness of 1000 denier in total. The 1000-denier bundles were collected into 900,000-denier bundle using a bundling machine. The collected bundle was treated with an aqueous solution of NaOH (40 g/liter) for about 1 hour for etching and surface roughening. Each of the 900,000-denier bundles formed from the polymers A, B, C, D, E, F, and G was dyed with a black disperse dye by a hank dyeing machine of high-pressure Smith type.

Each kind of the dyed black filaments was made into a wig and the appearance of the wig was examined by the naked eye indoor and outdoor under the sunlight. The surface of the individual filaments was examined by a scanning electron microscope. The irregularities on the filament surface were evaluated by means of the gradation that appears on a line drawn at right angles with respect to the fiber axis on the electron micrograph (×24000 and ×36000). The results are shown in Table 1.

TABLE 1

| | Fine particles | | | Surface roughening | | | Appearance of wig | | | |
|---|---|---|---|---|---|---|---|---|---|---|
| Polymer | Substance | Averge particle diameter | Refractive index | Weight decrease | Intervals of pits | Density of pits | Gloss under room-light | Resemblance to natural hair | Gloss under sun-light | Resemblance to natural hair under sunlight |
| A | Barium sulfate | 0.8 μm | 1.54 | 6% | 0.85 | 9 | Fair | Fair | Good | Good |
| B | Silica | 0.045 μm | 1.5 | 8% | 0.13 | 45 | Good | Good | Good | Good |
| C | Manganese phosphate | <0.01 μm | 1.6 | 8% | 0.21 | 23 | Good | Good | Good | Good |
| D | Calcium Carbonate | 0.5 μm | 1.67 | 7% | 1.41 | 6 | Fair | Fair | Fair | Fair |
| E | Silica | 0.08 μm | 1.5 | 8% | 0.25 | 23 | Good | Good | Good | Good |
| F* | — | — | — | 6% | 2.05 | 3 | Fair | Bad | Garish | Bad |
| G* | Titanium oxide | 0.2 μm | 2.5 | 6% | 1.8 | 2 | Poor | Whitish | Fair | Whitish |
| H* | Zinc white | 0.2 μm | 2.0 | 7% | 1.3 | 7 | Poor | Whitish | Fair | Whitish |

*Comparative Examples

EXAMPLE 2

Composite multiple-layer filaments having a cross section as shown in FIG. 1 (b) were prepared from polymer B used in Example 1 and polymer F'. Polymer F is identical with polymer F in composition but has a low intrinsic viscosity [η] of 0.56. Air-cooled melt spinning was performed, and the filaments were drawn in two stages using hot water baths at 75° C. and 98° C. Three kinds of filaments each having a single yarn fineness of 47 denier, 36 denier, and 28 denier were produced by changing the total throughput, while extruding polymer B and polymer F' equally. Drawn filaments were collected to form a 10,000 denier bundle. Then, a 700,000 denier skein was prepared using a reeling machine. The filaments were treated with an alkali for surface roughening as in Example 1 until the weight decreased by 6%, and then dyed by means of a high-pressure Smith dyeing machine.

| Dyeing conditions | | |
|---|---|---|
| Kayalon polyester | Dark brown | 3% owf |
| Kayalon polyester | Black | 0.2% owf |
| Kayalon polyester | Yellow | 2% owf |
| Kayalon polyester | Green | 1% owf |
| UV light absorber Sumipor UL | | 3% owf |
| Dyeing operation | | |
| From 60° C. to 135° C., for 60 minutes. | | |
| Bath ratio = 20:1 | | |

-continued

| Reduction clearing | |
|---|---|
| From 40° C. to 80° C., for 20 minutes. | |
| Bath ratio = 20:1 | |
| Hydrosulfite | 1 g/liter |
| NaOH | 1 g/liter |
| Amirazine | 1 g/liter |

Because of the symmetric multiple-layer structure, the filaments did not curl after dyeing. After finishing with an antistatic agent, the dyed filaments were made into a wig. The appearance of the wig was compared with that of the wigs prepared from polymer B and polymer F in Example 1. It exhibited a glossy appearance resembling that of natural hair under the sunlight.

EXAMPLE 3

Filaments having a modified cross section as shown in FIG. 2 (b) and (d) were prepared from polymer A and polymer B used in Example 1. Spinning and drawing were carried out in the same manner as in Example 1. Thus, three kinds of filaments each having a single yarn fineness of 30 denier, 40 denier, and 50 denier were produced. They were mixed at an equal ratio to make a filament bundle. The filaments were treated with an alkali for surface roughening as in Example 1 until the weight decreased by 6%, and then dyed.

The dyed filaments were made into a wig. After setting, the wig was tested to see if the filaments curl and pill when combed. For comparison, the same experiment was conducted with the round cross section filaments of polymer A and polymer B prepared in Example 1. The results are shown in Table 2.

TABLE 2

| | | Appearance of wig | | |
|---|---|---|---|---|
| Polymer | Cross section | Gloss under sunlight | Gloss under room light | Comb test |
| A | Cocoon-shaped | Good | Good | No curling and pilling |
| B | Cocoon-shaped | Good | Good | No curling and pilling |

TABLE 2-continued

| | | Appearance of wig | | |
|---|---|---|---|---|
| Polymer | Cross section | Gloss under sunlight | Gloss under room light | Comb test |
| A | Three-node-shaped | Fair | Good | No curling and pilling |
| B | Three-node-shaped | Fair | Good | No curling and pilling |
| A | Round | Fair | Fair | Curling and pilling |
| B | Round | Fair | Fair | Slight curling and pilling |

The wigs of the artificial hair thus produced were evaluated by actual wearing. In general, they were given a favorable reception because they kept their hair style better than the conventional wig of modacrylic fibers after sweating and bathing. The artificial hair having a round cross section exhibited a tendency to curling and pilling. By contrast, the artificial hair having a cocoon-shaped cross section and a three-node-shaped cross section kept the good hair style without curling. Moreover, the artificial hair of the invention retained its color because of its good fastness to light.

What is claimed is:

1. Polyester-based artificial hair which comprise a plurality of filaments of different denier as defined by the formula:

$$D=X\pm a$$

where

D is the denier,

X is the average denier, which is 30 to 70 denier, a is less than 20 denier and the individual filaments have a roughened, pitted surface, having average interval between adjacent pits of 0.1 and 1.5 μm and from 5 to 100 pits in a planar distance of 10 μm.

2. Artificial hair as claimed in claim 1, wherein more than 50% of the constituting filaments are those having an elliptic modified cross section defined by a/b=1.3 to 6.0, where a is the major axis and b is the minor axis.

3. Artificial hair as claimed in claim 1, wherein the constituting filaments are of side-by-side or coaxial multiple-layer structure composed of two or more components.

* * * * *